US007708611B2

(12) United States Patent
Simon-Bouhet

(10) Patent No.: US 7,708,611 B2
(45) Date of Patent: May 4, 2010

(54) SEA SURVIVAL DEVICE INCLUDING SEVERAL PNEUMATIC LIFERAFTS

(75) Inventor: Guillaume Simon-Bouhet, Chevanceaux (FR)

(73) Assignee: Zodiac International (FR)

( * ) Notice: Subject to any disclaimer, the term of this patent is extended or adjusted under 35 U.S.C. 154(b) by 0 days.

(21) Appl. No.: 12/022,169

(22) Filed: Jan. 30, 2008

(65) Prior Publication Data

US 2008/0188148 A1 Aug. 7, 2008

(30) Foreign Application Priority Data

Feb. 2, 2007 (FR) ..... 07 00749

(51) Int. Cl.
*B63B 35/38* (2006.01)

(52) U.S. Cl. ..... 441/41

(58) Field of Classification Search ..... 114/345; 441/41, 42

See application file for complete search history.

(56) References Cited

U.S. PATENT DOCUMENTS 4,033,002 A 7/1977 Higgs
4,362,517 A 12/1982 Martin
4,639,229 A 1/1987 Wright et al.
5,993,275 A 11/1999 Lavorata

FOREIGN PATENT DOCUMENTS

| | | |
|---|---|---|
| FR | 2756809 | 6/1998 |
| GB | 1181980 | 2/1970 |
| GB | 1465062 | 2/1977 |

*Primary Examiner*—Ed Swinehart
(74) *Attorney, Agent, or Firm*—Dean W. Russell; Kristin M. Crall; Kilpatrick Stockton LLP

(57) ABSTRACT

A sea survival device (1) comprising a container (2) with several shells (3, 4) enclosing respective pneumatic liferafts (5, 6) in the deflated and folded-up state, and inflation means; one half-shell (4) enclosing a liferaft (6) is closed by a closure partition (7); the automatically triggered inflation means are operationally associated with at least the first liferaft (5) in a manner such that said first liferaft (5) is inflated first when the survival device (1) is deployed operationally; and the liferaft (6) is operationally associated with inflation trigger means suitable for trigging inflation thereof only once the first liferaft (5) is inflated.

16 Claims, 6 Drawing Sheets

FIG. 2.
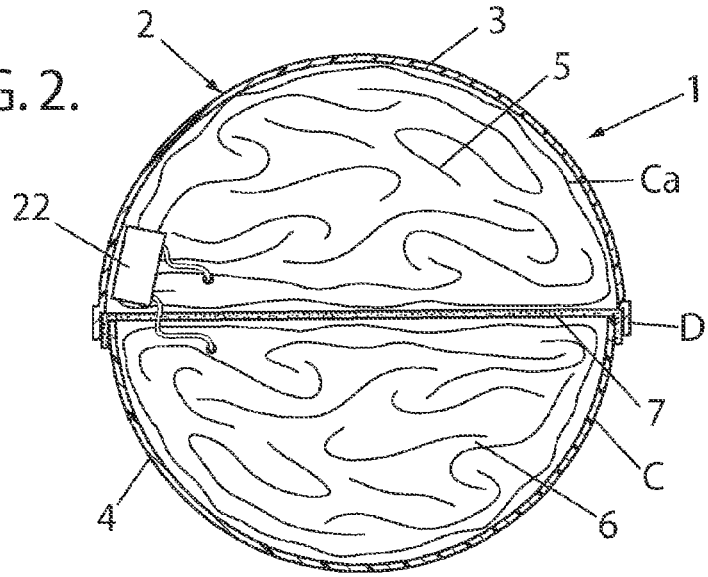
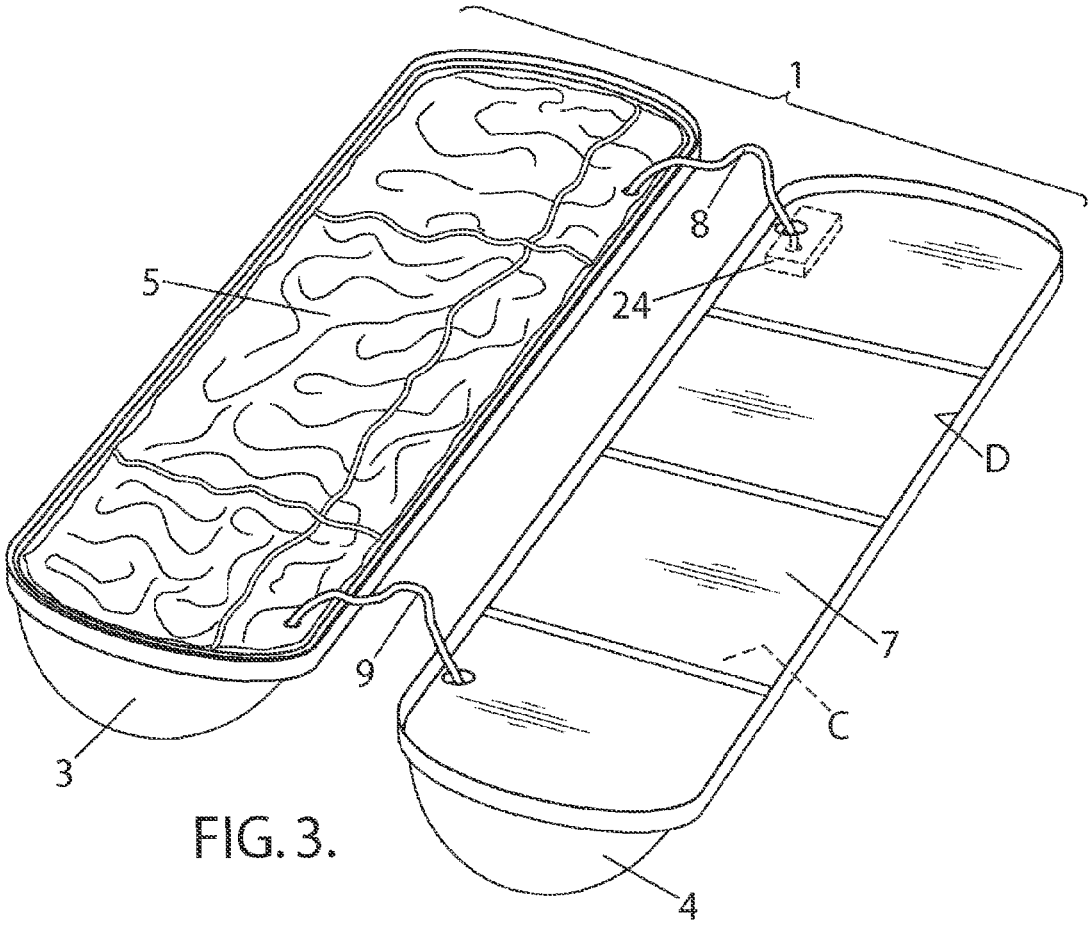
FIG. 3.

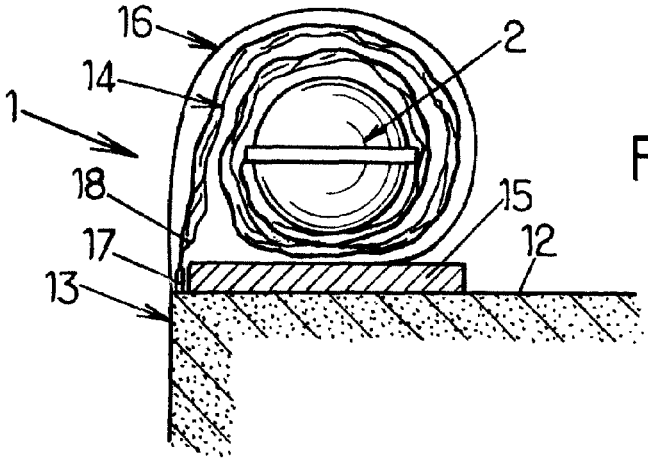
FIG.6.
FIG.7.
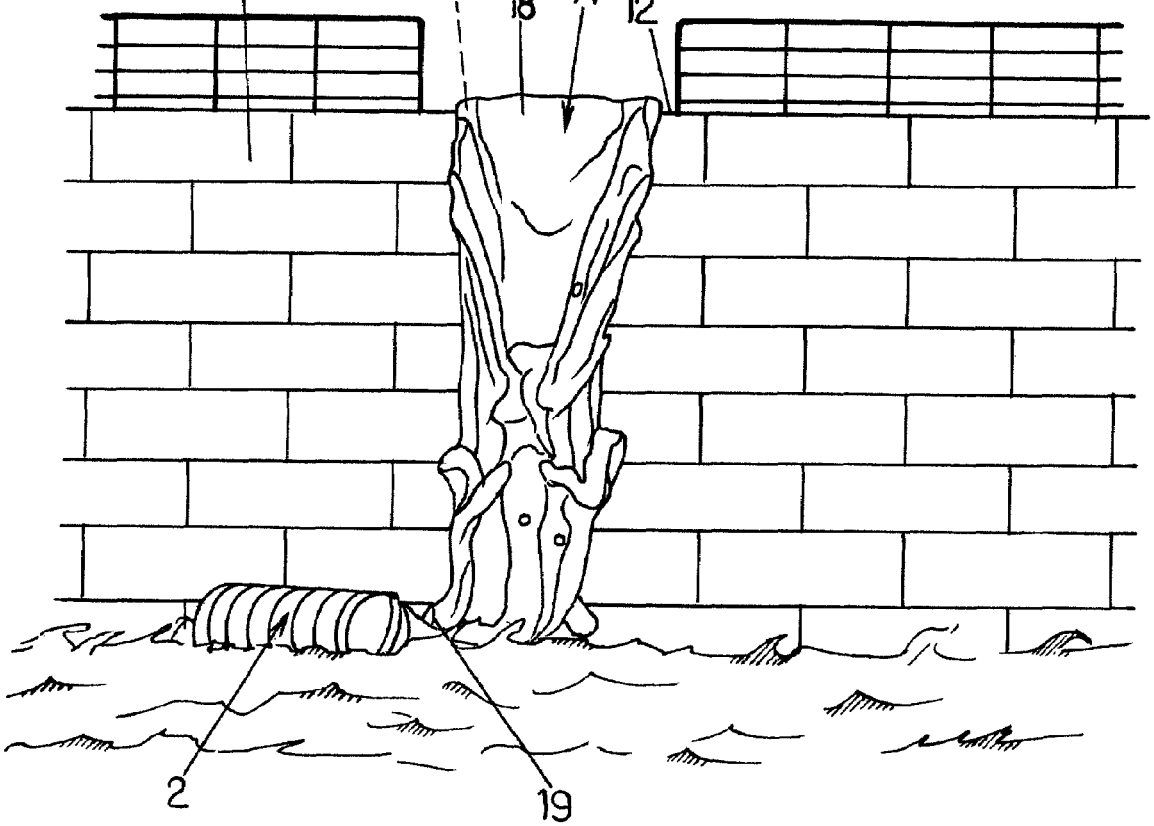

SEA SURVIVAL DEVICE INCLUDING SEVERAL PNEUMATIC LIFERAFTS

CROSS-REFERENCED TO RELATED APPLICATION

This application claims the benefit of French Patent Application No. FR 07 00749 filed with the French Patent Office on Feb. 2, 2007, the contents of which are incorporated herein by reference.

FIELD OF THE INVENTION

The present invention relates in general to the field of survival at sea and, more specifically, it relates to improvements made to a sea survival device comprising a container that encloses several pneumatic liferafts in the deflated and folded-up state, together with inflation means for inflating said liferafts while the device is being deployed operationally.

DESCRIPTION OF THE PRIOR ART

Sea survival devices of the above-mentioned type are already known, with two pneumatic liferafts enclosed in a common container.

Thus, document U.S. Pat. No. 4,362,517 discloses a set of two pneumatic liferafts housed, in the deflated and folded-up state, in a common rigid container, together with common inflation means. On inflation, the two liferafts are deployed simultaneously while coupled together. However, simultaneously deploying the two liferafts is possible only when they are relatively small in size. Simultaneous inflation is impossible, in practice, when they are liferafts of high-capacity or indeed of very high capacity (e.g. for 100 or more people), and, even more so, when they are liferafts of the self-righting type that must be isolated from each other in order to right if necessary.

Document U.S. Pat. No. 4,639,229 discloses a parachutable survival device that comprises a container enclosing two pneumatic liferafts; on being parachuted, the container is opened and the two liferafts, which are themselves suspended from respective parachutes and which are united by a long floating rope, are released in time-shifted manner and are deposited on the water at some distance apart from each other. Such a device is specifically arranged for aircraft rescue of survivors in water, but it is not structurally and functionally designed to be deployed from a ship carrying passengers (liner, ferry, etc.) or from an offshore platform, in order to enable a large number of people to survive at sea.

SUMMARY OF THE INVENTION

An essential object of the invention is to propose an improved arrangement of a sea survival device including several pneumatic liferafts that is suitable for enabling the liferafts to be operationally deployed rapidly, including and especially when the liferafts are of high-capacity or indeed of very high capacity and/or when they are of the self-righting type, the device also, if necessary, being capable of incorporating means for rapidly evacuating a large number of people from a ship.

To these ends, the invention provides a sea survival device comprising a container that encloses several pneumatic liferafts in the deflated and folded-up state, together with inflation means, which sea survival device, as arranged according to the invention, is characterized:

- in that the container is made up of several rigid shells that are assembled together;
- in that the container encloses at least one internal partition that subdivides it into several compartments, the number of which is equal to the number of the shells, and in that the partitions are secured to the respective shells, a shell of one compartment (a "first" compartment) not being secured to any partition;
- in that the liferafts as deflated and folded-up are disposed in respective ones of the compartments, said first compartment enclosing a first liferaft;
- in that the inflation means are of the automatically triggered type and are associated functionally with at least the first liferaft disposed in the first compartment in a manner such that it is the first liferaft that is inflated first when the survival device is deployed operationally; and
- in that the other liferafts are associated operationally with inflation trigger means suitable for trigging inflation of them in succession and one at a time after the first liferaft has been inflated.

By means of these features, each liferaft is inflated separately, and can be deployed without being hindered by another liferaft, which is essential for operationally deploying liferafts of very high capacity and thus of very large dimensions. In addition, it is essential for the liferafts to be deployed individually when they are self-righting liferafts, whose self-righting capacity can be guaranteed only if nothing hinders them as they are righting in the event that they are inflated upside-down.

With regard to sequential inflation of the liferafts, various solutions can be considered. Thus, depending on the operating needs, it is possible to make provision for the inflation trigger means of the other liferafts to be of the manually actuated type, or of the automatically triggered type associated functionally with means for detecting the end of inflation of the previously inflated liferaft.

It is possible to make provision for the inflation means to comprise several inflation means operationally associated with respective ones of the liferafts, for the inflation means to be common to the liferafts.

It is also possible for a tie to be provided between the successive liferafts in a manner such that, while a liferaft is being inflated, the remaining portion of the container enclosing the other liferafts remains secured to the liferaft that is being inflated. Naturally, the tie is flexible and is of a length that is sufficient for the floating remaining portion of the container not to be swept too far away while the first liferaft is being deployed, but also for it not to hinder deployment of that preceding liferaft.

The features that are descried above can apply as they are to sets of several liferafts, which makes it possible to reduce the amount of space necessary on the deck of the ship for stowing the container enclosing the liferafts (for the same liferaft capacity, such a common container is significantly less voluminous and less heavy than several containers each enclosing a single liferaft).

However, the features of the invention would seem to find a particularly advantageous application in the context of high-capacity and high-speed evacuation systems with which large ships for carrying passengers (liners, ferries, etc.) are currently or soon to be provided. It is, in particular, in this context that it is possible to make provision for the first liferaft of the present invention to be a boarding platform, at least a portion of which is arranged as a zone for receiving evacuees, in particular by means of rapid evacuation means. An example of such a boarding platform with a reception zone is given in document FR 2 756 809. Also in this context, it is then possible to make provision for the survival device to further comprise an inflatable pneumatic slide that, when the device is in the stowed condition, is folded up and rolled up around the container from its entry end which is secured to the container. Advantageously, the device can further comprise fastening means that, in the in-use position, are suitable for securing the exit end of the slide to the first liferaft in register with the reception zone provided therein. Also in the same context, it is possible for tie means to be provided for securing the first liferaft to each of the other liferafts with their sides touching once they are deployed (optionally one after another) in a manner such as to make it easier for people to go from one liferaft to another, in particular from the boarding platform to the liferaft proper. The features that are described above can find a particularly advantageous application for liferafts of very high capacity (typically several tens of people, or indeed more than about one hundred people) that are starting to equip ships for carrying passengers (cruise liners or other liners, car ferries, etc.).

The features that are described above find a particularly advantageous application for constituting sets of two liferafts, in other words in a device comprising a container that is made up of two half-shells, namely a first half-shell and a second half-shell that are assembled together and that enclose respective ones of the first and second pneumatic liferafts in the deflated and folded-up state, together with inflation means, which sea survival device is characterized:

- in that the first and second liferafts as deflated and folded-up are disposed in respective ones of the two half-shells;
- in that the second half-shell enclosing the second liferaft is closed by a closure partition;
- in that the inflation means are of the automatically triggered type and are associated functionally with at least the first liferaft disposed in the first half-shell in a manner such that it is the first liferaft that is inflated first when the survival device is deployed operationally; and
- in that the second liferaft is operationally associated with inflation trigger means suitable for trigging inflation thereof only once the inflation of the first liferaft is complete.

In practical manner, the inflation trigger means of the second liferaft may be of the manually actuated type, or indeed of the automatically actuated type operationally associated with means for detecting the end of inflation of the first liferaft.

It is possible to make provision for the inflation means to comprise first and second inflation means that are operationally associated with respective ones of the first and second liferafts, or indeed for the inflation means to be common to the first and second liferafts.

It is desirable that, while the device is being deployed, the various elements remain secured together. To this end, it is possible to provide a tie between the first liferaft and the second liferaft in a manner such that, whenever the container opens and while the first liferaft is being inflated, the closed second half-shell enclosing the second liferaft remains secured to the first liferaft.

The first liferaft may be a boarding platform, at least a portion of which is arranged as a zone for receiving evacuees. The device may then further comprise an inflatable pneumatic slide that, when the device is in the stowed condition, is folded up and rolled up around the container from its exit end; the device may further comprise fastening means that, in the in-use position, are suitable for securing the exit end of the slide to the first liferaft in register with the reception zone provided therein. Optionally, the device may advantageously further comprise tie means for securing the first and second liferafts together with their sides touching once they are deployed.

BRIEF DESCRIPTION OF THE DRAWINGS

The invention will be better understood on reading the following detailed description of preferred embodiments that are given merely by way of illustrative example. In the description, reference is made to the accompanying drawings, in which:

FIG. 2 is a diagrammatic cross-section view of a preferred embodiment of a survival device arranged in accordance with the invention;

FIG. 3 is a diagrammatic perspective view of the survival device of FIG. 2 in the open position;

FIG. 6 is a highly diagrammatic end view of a preferred variant embodiment of a survival device of the invention;

FIG. 7 is a highly diagrammatic side view of the survival device of FIG. 6 while it is being deployed.

DETAILED DESCRIPTION OF THE INVENTION

Figure 1:
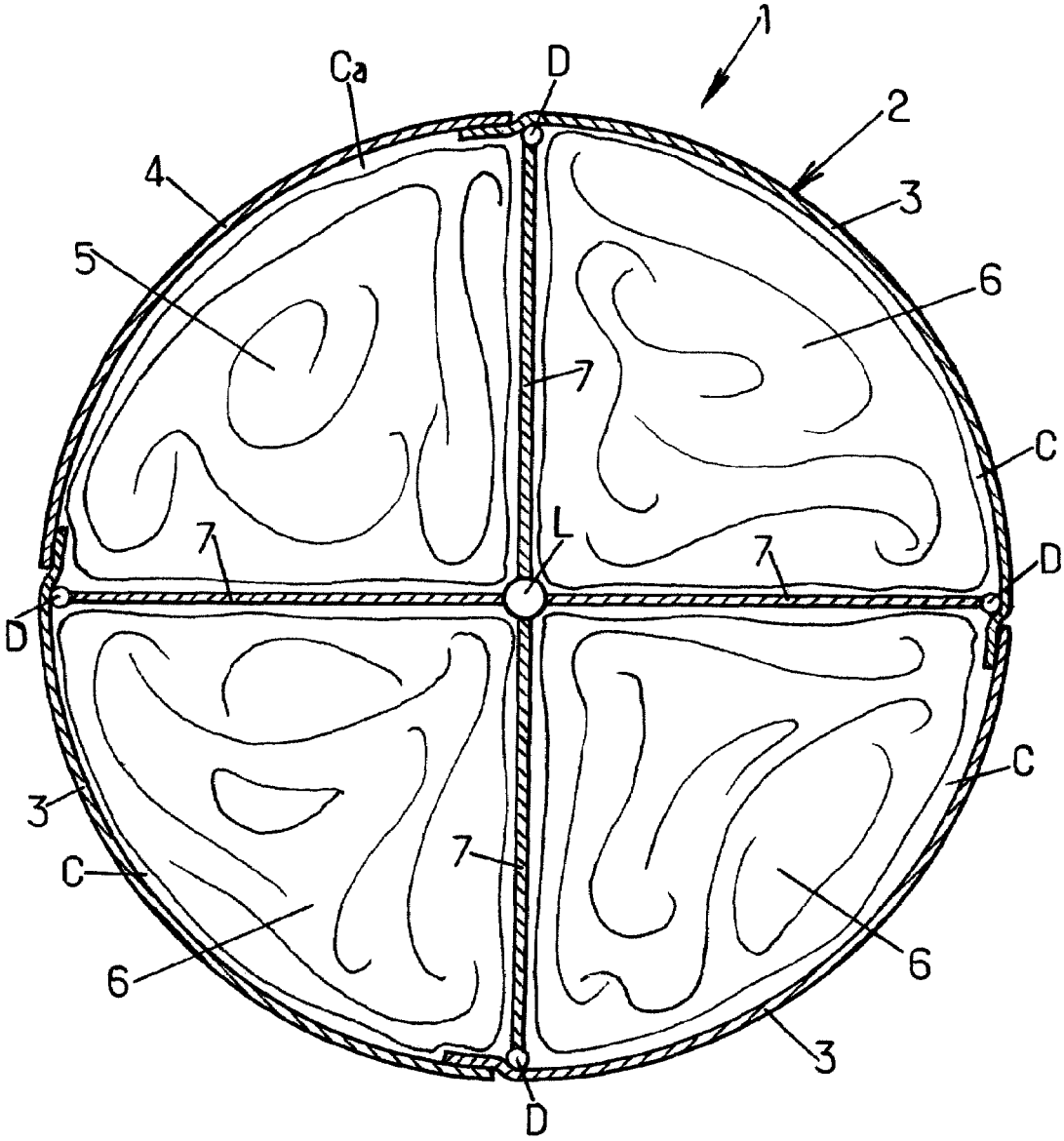
FIG. 1 is a diagrammatic cross-section view of a survival device arranged in accordance with the invention.

Reference is made firstly to FIG. 1 which is a highly diagrammatic view of a sea survival device that is designated by overall numerical reference 1, and that comprises a container 2 enclosing several pneumatic liferafts in the deflated and folded-up state together with suitable inflation means for inflating said liferafts. In accordance with the invention, the sea survival device 1 is arranged as explained below.

The container 2 is made up of several assembled-together rigid shells 4, one of which is a special shell 3 that is described below. The shells 3, 4 can be made of any suitable material used for manufacturing containers designed to enclose liferafts, and the shells are shaped in a manner such that the container 2 has any desired shape that is appropriate for performing its function; the shells 3, 4 are mechanically assembled together in a manner such as to impart the required strength to the container, in particular if it is designed to be thrown into the water from a deck of a ship, or from a platform.

The container 2 encloses at least one internal partition 7 that subdivides it into several compartments C, the number of which is equal to the number of the shells 3, 4. In the example shown merely by way of illustration in FIG. 1, the container 2 is provided with four internal partitions 7 that are advantageously disposed in a cross configuration, that are secured together (e.g. they radiate from a central link L), and that define four compartments C, each representing about one fourth of the internal volume of the container 2, and the container 2 is defined by four shells 3, 4, each of which extends over about one fourth of the perimeter of the container 2. The partitions 7 are secured at D to the shells 3, 4, but said shell 4 of a compartment Ca (which is referred to as the "first" compartment below) is not secured to any partition, as shown in FIG. 1; as a result, the two partitions 7 that define said first compartment Ca are secured to the edges of the two shells 3 that are adjacent to the shell 4 closing said first compartment Ca.

The liferafts in the deflated and folded-up state, the number of which is equal to the number of compartments C, are enclosed in respective ones of the compartments C. Said first compartment Ca encloses a liferaft referenced 5 that is referred to the "first" liferaft below, and the other compartments C enclose respective liferafts that are referenced 6.

Finally, the inflation means (not shown in FIG. 1) are of the automatically triggered type, and they are operationally associated with at least the first liferaft 5 disposed in the first compartment Ca so that it is the first liferaft 5 that is inflated first when the liferaft is deployed operationally.

Figure 4:
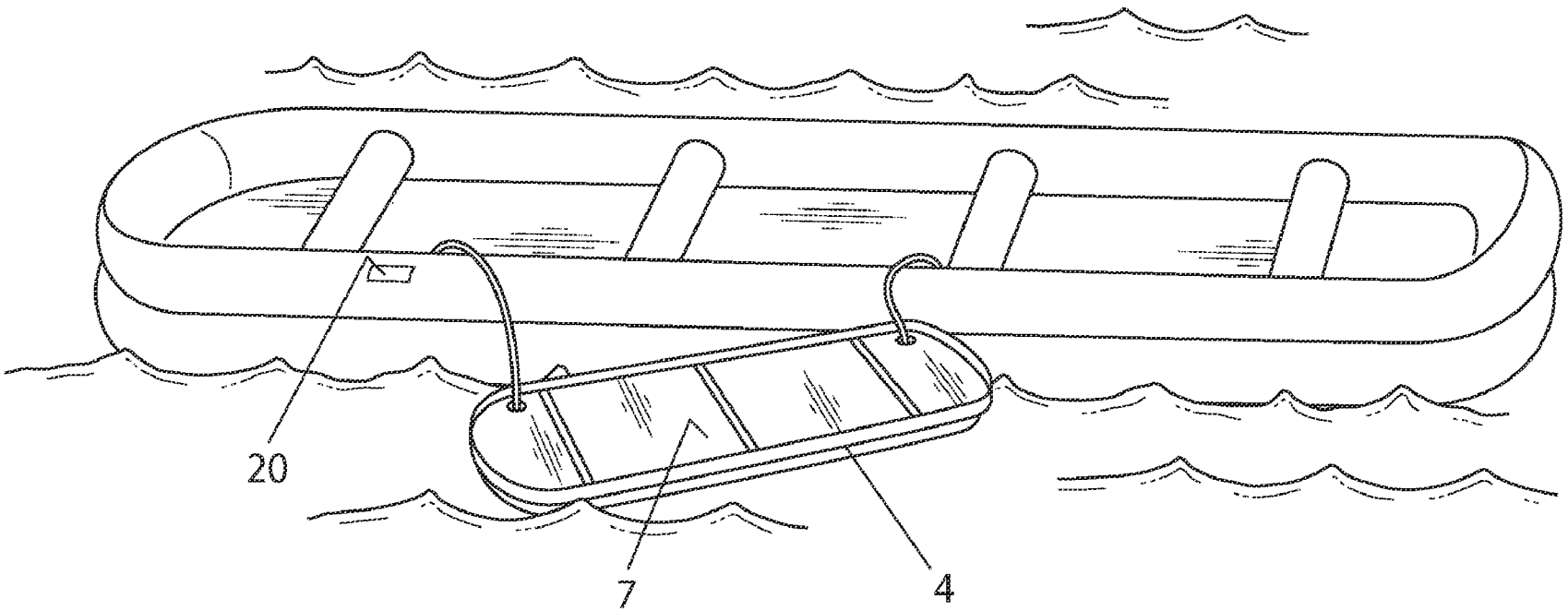
FIG. 4 is a diagrammatic perspective view of the survival device of FIG. 2 after a first liferaft has been inflated.

The other liferafts 6 are operationally associated with inflation trigger means (not shown) that are suitable for triggering inflation of their respective liferafts in succession and one at a time, after the first liferaft 5 has been inflated. Said inflation trigger means of the other liferafts 6 can be of the manually actuated type or else they can be of the automatically actuated type, operationally associated with detection means 20, as shown in FIG. 4, for detecting the end of inflation of the liferaft 5 that is inflated previously.

Depending on the applications and on the modes of deployment required for the survival device 1, it is possible to make provision for the inflation means to comprise several inflation means operationally associated with respective ones of the liferafts 5, 6, but it is also possible to make provision for the inflation means to be common to all of the liferafts, or to respective groups of liferafts.

In order for it to be possible for the liferaft 1 to be deployed reliably and entirely safely, it is desirable for all of the elements (the liferafts being deployed or already inflated, and the portions of the container that are still closed) to remain associated with one another both so as to enable them to be deployed fully and so as to enable the passengers to board them safely, in particular in the configuration explained below. To these ends, it is desirable to provide a tie between the successive liferafts so that, while a liferaft is being inflated, the remaining portion of the container that encloses the other liferafts remains secured to the liferaft that is being inflated or that has been inflated.

In an advantageous configuration of the survival device 1, in particular when it is designed for evacuating a large number of people onto liferafts of high-capacity or indeed of very high capacity (e.g. 100 or 150 people), it is advantageous for the first liferaft 5 to be a boarding platform, at least a portion of which is arranged as a zone for receiving the evacuees.

The general features of the invention that are described above can be complex to implement in practice if the number of liferafts enclosed in the container is large (a container of very large size and thus of very large weight is difficult to throw from up on a deck, and it is difficult and lengthy to deploy the liferafts, etc.).

Consequently, an embodiment that is practical to implement from all points of view, and that therefore constitutes the currently preferred embodiment, consists in a survival device comprising a container arranged to enclose two liferafts, and this particular embodiment, which is currently preferred and which satisfactorily complies with practical requirements, is described in more detail below, it being understood that the particular features mentioned in the context of a survival device comprising a container enclosing two liferafts can be extrapolated for a survival device comprising a container enclosing a larger number of liferafts.

FIG. 2 is a highly diagrammatic view of a sea survival device designated by overall numerical reference 1, which device mainly comprises a container 2 made up of two rigid and strong half-shells, respectively a first half-shell 3 and a second half-shell 4, that are assembled together. This container 2 respectively encloses first and second pneumatic liferafts 5, 6 in the deflated and folded-up state, together with inflation means (a common inflation means 22 is shown, although it should be understood that each liferaft may have its own individual inflation means, as described in more detail below) and all of the equipment (not shown) necessary for operating the liferafts. The design of the container 1, of the liferafts 5, 6, and of all of the rest of the equipment can be of any type.

In accordance with the invention, provision is made for the first and second liferafts 5, 6 as deflated and folded-up to be disposed in respective ones of the compartments Ca, C of the first and second half-shells 3, 4 of the container 2, and the container 2 is arranged such that the second half-shell 4 enclosing the second liferaft 6 is closed in watertight manner at D by a closure partition 7. For greater clarity, in FIG. 3, the container 1 is shown open, the two half-shells 3 and 4 being disposed side-by-side. The first liferaft 5 disposed in the first half-shell 3 that is open can be seen clearly, while the second half-shell 4, enclosing the second liferaft 6 (not shown), is closed by the partition 7 which is secured to it at D in watertight manner in any suitable manner.

In addition, the inflation means are of the automatically triggered type and they are operationally associated with at least the first liferaft 5 disposed in the first half-shell 3 so that it is the first liferaft 5 that inflates first when the survival device 1 is deployed operationally. This is the situation that is shown in FIG. 4: the survival device 1 has been launched (e.g. by being thrown from the deck of a ship), the inflation means have been triggered, and the first liferaft 5 is nearly fully inflated or has just been inflated as shown, while the second liferaft is still enclosed in the second half-shell 4 closed by the partition 7 because the second liferaft 6 is operationally associated with inflation trigger means 24 (as shown in FIG. 3) that are suitable for triggering inflation of the second liferaft only once inflation of the first liferaft 5 is complete.

As shown in FIG. 3, the inflation trigger means 24 of the second liferaft 6 can be of the manually actuated type: e.g. a crew member steps into the first liferaft 5 as soon as it is fully inflated, and triggers inflation of the second liferaft 6 by manually pulling on a percussion cord 8 (cord 8 is also shown in FIG. 4). Or, alternatively, the inflation trigger means 24 of the second liferaft 6 can be of the automatically triggered type operationally associated with detection means 20 suitable for detecting the end of inflation of the first liferaft 5.

Depending on the operating constraints and on the cost constraints, the inflation means can comprise first and second inflation means operationally associated with respective ones of the first and second liferafts 5, 6, each pressurized gas reservoir being wrapped in the folded-up canvas of the corresponding liferaft, as is common practice in a container enclosing a single liferaft. But, if necessary, it is possible to make provision for the inflation means to be common to the first and second liferafts (as shown by the common inflation member 23 of FIG. 2) with the inflation gas source being connected selectively to the appropriate liferaft. However, the single pressurized gas reservoir is then voluminous and relatively difficult to accommodate inside the container.

Preferably, at least one tie 9 or lashing rope is provided between the first liferaft 5 and the second liferaft 6 in a manner such that, whenever the container 2 opens, and during inflation of the first liferaft 5, the closed second half-shell 4 enclosing the second liferaft 6, at least so long as it has not been inflated, floats in the vicinity of the first liferaft 5 while remaining secured thereto as shown in FIG. 4.

Figure 5:
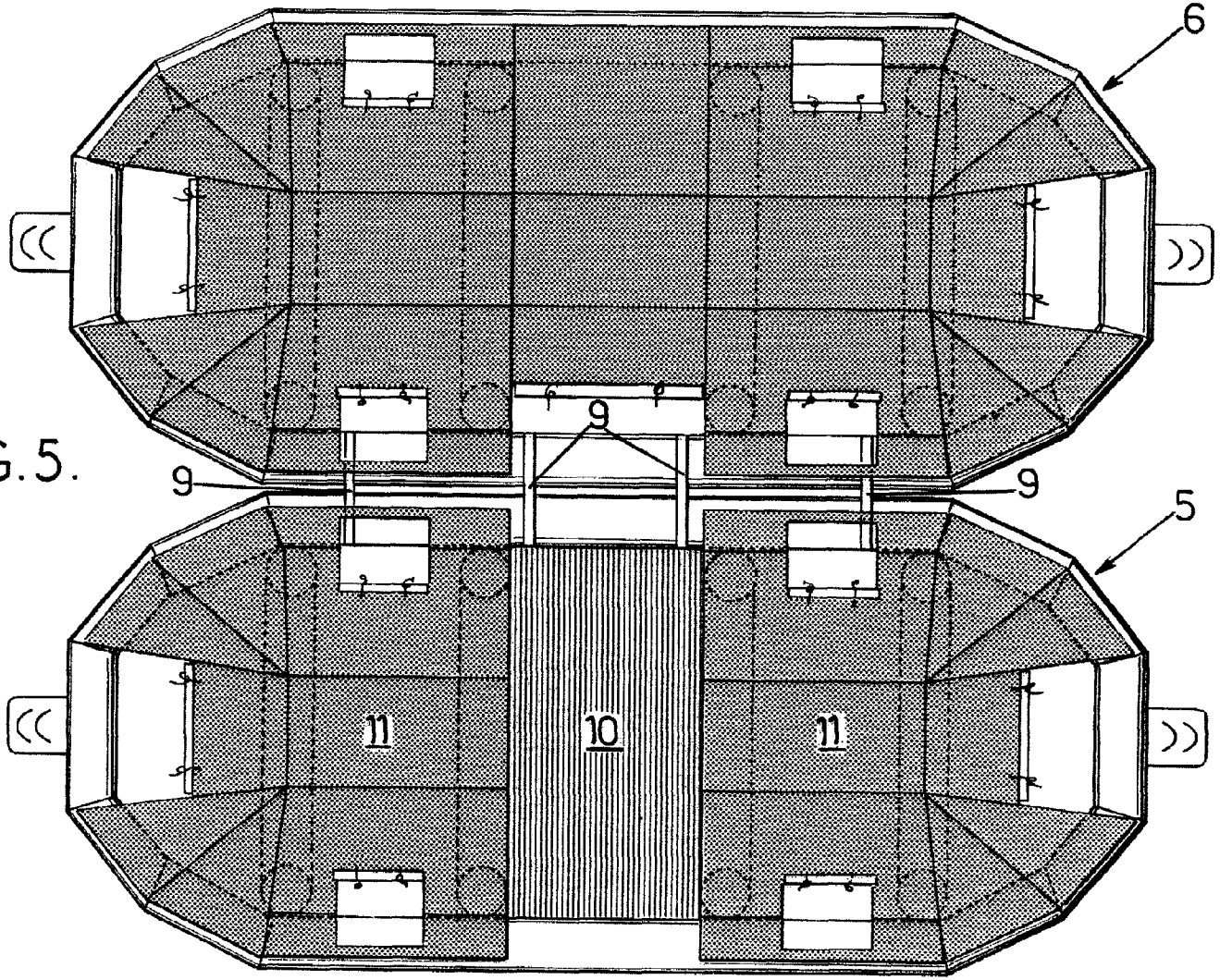
FIG. 5 is a diagrammatic view from above of the survival device of FIG. 2 after the second liferaft has been inflated.

FIG. 5 shows the two liferafts 5 and 6 as inflated and, by way of example, as lashed together with their sides touching, in particular so as to make it easier for passengers to board and to be spread out once they have boarded.

The features of the invention as described above can be applied to various practical operating configurations. However, it seems that a particularly advantageous application of the invention relates to survival devices designed for a large number of people, e.g. for equipping large ships for carrying passengers (such as liners, cruise ships, car ferries, etc.). For equipping such ships, high-capacity or indeed very high capacity liferafts (typically for several tens of passengers or indeed for over one hundred passengers) are currently provided. Unfortunately, operationally deploying such liferafts poses numerous problems as regards both deploying the liferafts properly on the water, and also transferring the passengers onto them. The currently developed solution consists in using rapid mass evacuation means of the gravity type, which requires the evacuated passengers to land firstly on a reception platform from which they are immediately removed so as not to hinder the following evacuees.

It is in this context that the features of the invention appear to be particularly advantageous. It is then possible to make provision, as applies in the liferaft configuration shown in FIG. 5, for the first liferaft 5 to be a boarding platform, at least a portion of which is unobstructed and arranged as a zone 10 for receiving evacuees. Document FR 2 756 809 discloses an arrangement of such a reception platform. The received people are removed immediately from the reception zone 10 and they are ushered either to adjacent zones 11 of the same craft 5 or, preferably, to a liferaft (that then constitutes the above-mentioned second liferaft 6) that is lashed alongside it. Thus, in accordance with the invention and logically, the reception platform 5 (constituting the above-mentioned first liferaft in the context of the invention) is inflated first, whereas the second liferaft 6 is inflated only once the reception platform 5 is fully inflated; it is even possible to make provision to start receiving the first evacuees on the reception platform 5 while the second liferaft 6 is still being inflated.

Among the various rapid mass evacuation means of the gravity type that are currently in use or being tested are pneumatic slides that can be stowed in relatively small volumes in the deflated and folded-up state. It is then possible to make provision to construct a sea survival device in which a pneumatic slide is associated with a container enclosing two liferafts as described above.

FIG. 6 is a highly diagrammatic view of an example of such a survival device 1 in a stowed situation, e.g. on a deck 12 of a ship 13, ready to be deployed operationally. The deflated slide 14 is in the form of an elongate flexible canvas element that is rolled up around the container 2 which is arranged as indicated above, it being possible for the resulting assembly to rest on a suitable cradle 15 and optionally to be covered with a protective tarpaulin 16 that is easy and quick to remove. The external end 18 of the slide in the rolled-up situation (which end becomes the top end or entry end of the slide once the slide is deployed and inflated) is secured to the deck in any suitable manner by securing means shown diagrammatically at 17. The other end 19 (or exit end) of the slide 14 is secured (by means not shown in the figures) to the container 2, or more precisely to the first liferaft 5 enclosed therein.

In order to be deployed, and after any tarpaulin 16 has been removed, the survival device 1 stowed on the deck 12 is released and thrown overboard. Entrained by the weight of the container 2, the slide canvas 14 unrolls until it reaches the surface of the water and retains the container 2 floating on the water, as shown in FIG. 7.

It should be emphasized that, by the very design of the survival device as a whole, the slide canvas is secured, at its top end or entry end 18, to the deck 12 of the ship 13 by the securing means 17 (shown diagrammatically in FIG. 8 by lashing ropes 15 fastened to rings 16 or to any other members provided on the deck 12) and, at its bottom end or exit end 19, to the first liferaft 5.

In a preferred but non-exclusive mode of deployment, firstly inflation of the slide 14 is triggered by its own inflation means (not shown), then inflation of the first liferaft 5 can be triggered, by any suitable means (manual by pulling a percussion cord, or automatic triggered by the end of inflation of the slide) under the conditions described above.

Once the first liferaft 5 and/or the slide 14 have/has finished inflating, inflation of the second liferaft 6 is triggered, it being possible for the second liferaft to be inflated together with the slide 14 being inflated.

Figure 8:
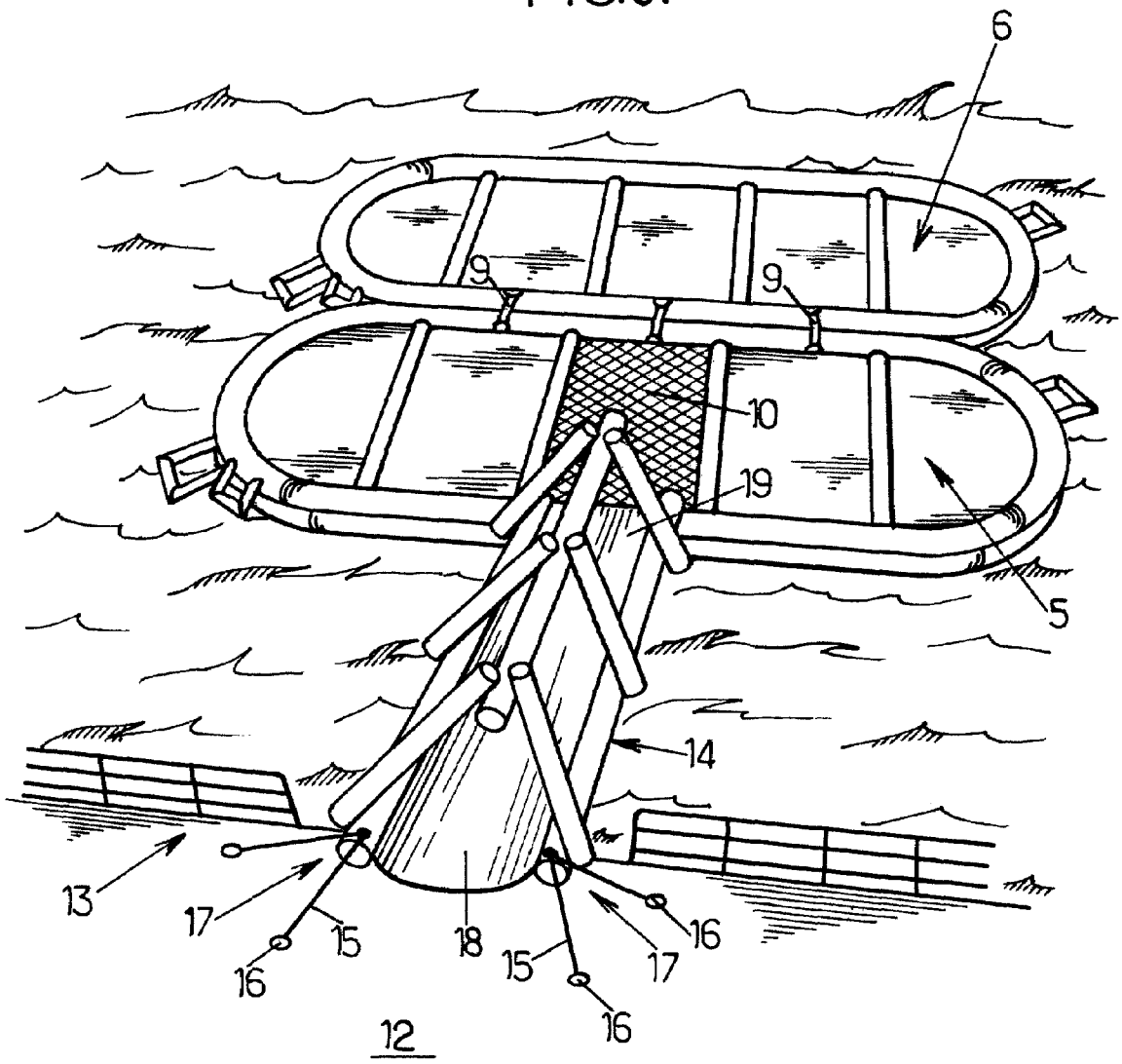
FIG. 8 is a diagrammatic perspective view of the survival device of FIG. 6 in an operational position.

Finally, when in the operational position as shown in FIG. 8, the survival device 1 has both liferafts 5 and 6 inflated and lashed together with their sides touching (in FIG. 8, the canvas shelters covering the two liferafts in FIG. 6 are not shown), with the slide 14 inflated and extending from the deck 12 of the ship to which it is lashed at 17 to the first liferaft 5 to which it is lashed (the lashings are not shown in FIG. 8), while terminating in front of or onto the reception zone 10 of the first liferaft 5 that forms the reception platform.

What is claimed is:

1. A sea survival device comprising a container that encloses at least first and second pneumatic liferafts in a deflated and folded-up condition, the first and second liferafts configured to cooperate with an inflation member:

wherein the container comprises at least first and second rigid shells that are assembled together;

wherein the container encloses at least one internal partition that subdivides the container into at least first and second compartments delimited in part by the at least first and second shells, wherein the at least a second rigid shell has the at least one internal partition secured thereto, and wherein the first shell does not have an internal partition secured thereto;

wherein the at least first and second compartments house respectively the first and second deflated and folded-up liferafts;

wherein the first liferaft is automatically inflated first when the sea survival device is deployed; and wherein inflation of the at least a second liferaft or any additional liferafts is not triggered until after the first liferaft has been inflated.

2. A survival device according to claim 1, wherein the at least a second liferaft or any additional liferafts is configured to be manually inflated.

3. A survival device according to claim 1, wherein the at least a second liferaft or any additional liferafts is configured to be automatically inflated upon the end of inflation of a previously inflated liferaft, such that liferafts inflated subsequent to the first liferaft are inflated in succession and one at a time.

4. A survival device according to claim 1, wherein a tie is provided between the liferafts such that, while a one liferaft is being inflated, the container enclosing any subsequent liferafts remains secured to the liferaft that is being inflated.

5. A survival device according to claim 1, wherein the first liferaft is a boarding platform that has a portion arranged as a reception zone for receiving evacuees.

6. A survival device according to claim 5, further comprising an inflatable pneumatic slide that has an entry end, wherein when the device is not in use, the slide is folded up and rolled up from the entry end around the container.

7. A survival device according to claim 5, further comprising an inflatable pneumatic slide that has an entry end, wherein when the device is not in use, the slide is folded up and rolled up from the entry end around the container, and a fastening member that, in use is adapted to secure the exit end of the slide to the first liferaft at the reception zone.

8. A survival device according to claim 5, further comprising a tie member that is adapted to secure the first liferaft to at least the second liferaft and any additional liferafts with liferaft sides touching once the liferafts are deployed.

9. A sea survival device comprising a container that encloses first and second pneumatic liferafts in a deflated and folded-up condition, the first and second liferafts configured to cooperate with an inflation member:

wherein the container comprises first and second rigid shells that are assembled together;

wherein the container encloses an internal partition that subdivides the container into first and second compartments delimited in part by the first and second shells, wherein the second rigid shell has the internal partition secured thereto, and wherein the first shell does not have an internal partition secured thereto;

wherein the first and second compartments house respectively the first and second deflated and folded-up liferafts;

wherein the first liferaft is automatically inflated first when the sea survival device is deployed; and wherein inflation of the second liferaft is not triggered until after the first liferaft has been inflated.

10. A survival device according to claim 9, wherein the second liferaft is configured to be manually inflated.

11. A survival device according to claim 9, wherein the second liferaft is configured to be automatically inflated upon the end of inflation of the first liferaft.

12. A survival device according to claim 9, wherein a tie is provided between the first liferaft and the second liferaft such that when the container opens in use and while the first liferaft is being inflated, the second shell that is closed by the closure partition so as to define the second compartment which houses the second liferaft remains secured to the first liferaft.

13. A survival device according to claim 9, wherein the first liferaft is a boarding platform that has a portion arranged as a reception zone for receiving evacuees.

14. A survival device according to claim 9, wherein the first liferaft is a boarding platform that has a portion arranged as a reception zone for receiving evacuees, and further comprising an inflatable pneumatic slide that has an entry end, wherein when the device is not in use, the slide is folded up and rolled up from the entry end around the container.

15. A survival device according to claim 9, wherein the first liferaft is a boarding platform that has a portion arranged as a reception zone for receiving evacuees, further comprising an inflatable pneumatic slide that has an entry end and an exit end, wherein, when the device not in use, the slide is folded up and rolled up around the container from the entry end, and further comprising a fastening member that, in use is adapted to secure the exit end of the slide to the first liferaft at the reception zone.

16. A survival device according to claim 9, wherein the first liferaft is a boarding platform that has a portion arranged as a reception zone for receiving evacuees, and further comprising a tie member adapted to secure the first and second liferafts together side-by-side once the first and second liferafts are deployed.

* * * * *